US006474299B1

(12) United States Patent
Langer

(10) Patent No.: US 6,474,299 B1
(45) Date of Patent: Nov. 5, 2002

(54) PROCESS FOR OPERATING AN INTERNAL COMBUSTION ENGINE, IN PARTICULAR OF A MOTOR VEHICLE

(75) Inventor: Winfried Langer, Markgrocningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/530,707

(22) PCT Filed: Nov. 2, 1999

(86) PCT No.: PCT/DE98/03193

§ 371 (c)(1),
(2), (4) Date: Jul. 28, 2000

(87) PCT Pub. No.: WO99/24705

PCT Pub. Date: May 20, 1999

(30) Foreign Application Priority Data

Nov. 5, 1997 (DE) ..... 197 48 745

(51) Int. Cl.[7] ..... F02D 31/00
(52) U.S. Cl. ..... 123/352; 123/399
(58) Field of Search ..... 123/352, 399, 123/396, 361; 73/118.1

(56) References Cited

U.S. PATENT DOCUMENTS

| | | | | |
|---|---|---|---|---|
| 4,290,400 A | | 9/1981 | Pomerantz | |
| 4,373,187 A | | 2/1983 | Ishii et al. | |
| 4,493,303 A | | 1/1985 | Thompson et al. | |
| 5,434,786 A | * | 7/1995 | Sakonjyu et al. | 123/352 |
| 5,662,085 A | * | 9/1997 | Aubourg et al. | 123/339.21 |
| 6,311,670 B1 | * | 11/2001 | Constancis | 123/352 |

FOREIGN PATENT DOCUMENTS

DE 196 09 242 9/1997

* cited by examiner

*Primary Examiner*—John Kwon
(74) *Attorney, Agent, or Firm*—Kenyon & Kenyon

(57) ABSTRACT

An internal combustion engine, in particular for a motor vehicle, that is provided with a control unit for controlling and/or regulating the power output by the internal combustion engine as a function of performance quantities of the internal combustion engine and, in particular, as a function of a driver request is described. A permissible variation in output power over a predetermined period of time and an actual variation in output power over a corresponding predetermined period of time can be determined and compared to one another by the control unit.

14 Claims, 1 Drawing Sheet

Figure 1:
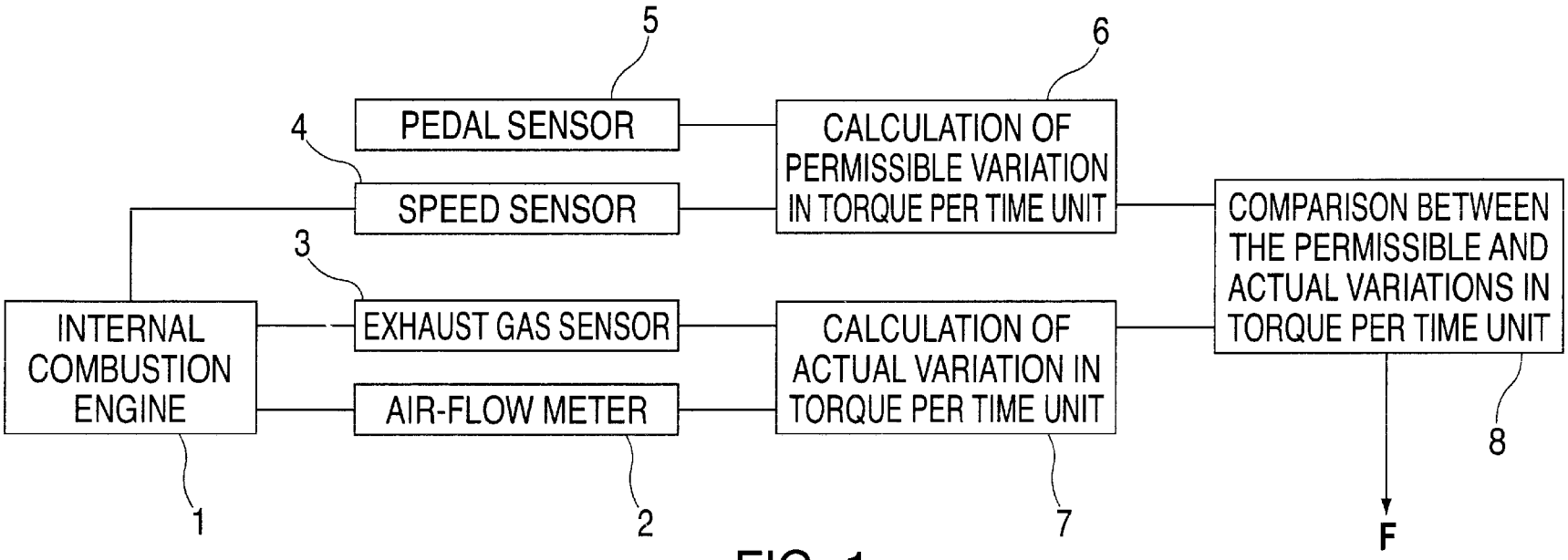

PROCESS FOR OPERATING AN INTERNAL COMBUSTION ENGINE, IN PARTICULAR OF A MOTOR VEHICLE

DESCRIPTION

The present invention relates to a method for operating an internal combustion engine, in particular for a motor vehicle, in which the power output by the internal combustion engine is controlled and/or regulated as a function of performance quantities of the internal combustion engine and, in particular, as a function of a driver request. The present invention also concerns an internal combustion engine, in particular for a motor vehicle, having a control unit for controlling and/or regulating the power output by the internal combustion engine as a function of performance quantities of the internal combustion engine and, in particular, as a function of a driver request.

A method and an internal combustion engine of this type are known, for example, from German Patent Application 1 96 09 242. According to this publication, the performance quantities of the internal combustion engine are determined with the help of a multiplicity of sensors and supplied to an electronic control unit. The latter processes the performance quantities and activates a multiplicity of actuators, such as the injection valves and spark plugs of the internal combustion engine, as a function of these performance quantities. The power output by the internal combustion engine is controlled and/or regulated in this manner to the value desired, in particular, by the driver.

It is possible for sensors, in particular, to demonstrate measuring errors, for example due to aging phenomena. The consequence of this is that the entire control and/or regulation action of the internal combustion engine becomes susceptible to errors over time and no longer corresponds to the value desired by the driver.

For example, if an air-flow meter provided in the intake manifold of the internal combustion engine generates an incorrect output signal, this can lead to an excessive amount of fuel being injected into the combustion chamber of the internal combustion engine. This causes the internal combustion engine to generate a power that is much higher than the power desired by the driver.

In the above-mentioned German patent application, a monitoring system is provided that is used to continuously compare the power actually output by the internal combustion engine to a permissible power. The permissible power is detected, for example, on the basis of the accelerator position, i.e., on the basis of the power desired by the driver. If the actual power of the internal,combustion engine exceeds this detected permissible power, a sensor error is concluded. Appropriate action can thus be taken, in particular to correct the error.

It is known that, due to tolerances, different sensors of the same type frequently generate different output signals under the same conditions. In the monitoring system described according to German Patent Application 1 96 09 242, these tolerances of the input sensors must additionally be taken into account when detecting the actual and permissible power. As a result, the monitoring system detects only a major sensor error as being impermissible.

The object of the present invention is to provide a method for operating an internal combustion engine in which even minor sensor errors are detected early on.

This object is achieved according to the present invention with a method of the type mentioned in the preamble and an internal combustion engine of the type mentioned in the preamble in that a permissible variation in output power over a predetermined period of time and an actual variation in output power over a corresponding predetermined period of time are determined and compared to one another.

Thus, instead of monitoring the actual and permissible power of the internal combustion engine as absolute quantities, the method according to the present invention uses the variations in these absolute quantities, i.e., relative quantities, for monitoring purposes. According to the present invention, therefore, the variations in the actual and permissible powers, respectively, of the internal combustion engine are determined over a certain predetermined period of time. These variations, i.e., the relative quantities, are then compared to each other and, as a function of this comparison, action is taken as needed to correct the error.

In sensors of the same type, the tolerances of the individual sensors have an influence only on their absolute output signals. As previously mentioned in the preamble, these absolute output signals can therefore also vary among different sensors of the same type under the same conditions. However, it can be assumed that the variations in output signals, i.e., their relative quantities, remain essentially more or less the same in all sensors of the same type. In particular, these relative quantities remain more or less the same over a predetermined, preferably relatively short, period of time.

In other words, this means that the output signals of different sensors within the same sensor type vary in more or less the same way under the same conditions and over the same period of time. The sensor tolerances are therefore no longer a factor when using the relative quantities, i.e., when comparing the variations in the actual and permissible power of the internal combustion engine over the same predetermined period of time.

This means that the sensor tolerances no longer have to be taken into account, and thus smaller, in particular abrupt, sensor errors can even be detected. In particular, it is possible according to the present invention to detect the relative quantities, i.e., the actual and permissible variations in power output by the internal combustion engine, much more accurately without considering the tolerances than was previously possible with the absolute quantities of the actual and permissible power. This results in the above-mentioned advantage that even smaller variations, and thus smaller sensor errors, can be detected and indicated.

In advantageous embodiments of the present invention, the permissible variation in output power over the predetermined period of time is determined as a function of the speed of the internal combustion engine or the driver request, in particular as a function of the variation in the position of an accelerator. These actions have proved to be particularly simple and yet accurate means for calculating the permissible variation in the power output by the internal combustion engine.

In a further advantageous embodiment of the present invention, the actual variation in output power over the predetermined period of time is determined as a function of the oxygen content of the emitted exhaust gas and/or as a function of the intake air flow. These actions have proved to be particularly simple and yet accurate means for calculating the actual variation in the power output by the internal combustion engine.

It is particularly suitable if an error signal is generated if the actual variation in output power over the predetermined period of time is greater than the permissible variation in output power over the same predetermined period of time.

This makes it possible to switch the internal combustion engine to an emergency mode, if necessary, or to alert the driver to the error and/or to take, some other action to correct the error.

In one advantageous :embodiment of the present invention, the performance quantities acting upon the internal combustion engine are converted: to torques, in particular to a permissible and an actual variation in a torque output by the internal combustion engine. Especially in the case of torque-driven internal combustion engines, and particularly in the case of lean-mix engines or engines with direct fuel injection, this has proven to be an especially effective means of monitoring the sensors.

It is especially important to implement the method according to the present invention in the form of an electric storage medium that is provided for a control unit of an internal combustion engine, in particular for a motor vehicle. On the electric storage medium is stored a program that can run on an arithmetic unit, in particular on a microprocessor, and is suitable for carrying out the method according to the present invention. In this case, therefore, the present invention is implemented by a program stored on the electric storage medium so that this storage medium provided with the program is equally representative of the present invention as the method which it is suitable to carry out.

Further features, applications, and advantages of the present invention can be derived from the following description of embodiments of the present invention, which are illustrated in the drawing. All described or illustrated features form the object of the present invention, either by themselves or in any combination, regardless of their combination in the patent claims or their references as well as independently of their formulation and depiction in the description and in the drawing, respectively.

The one FIGURE in the drawing shows a schematic block diagram of one embodiment of a method according to the present invention for operating an internal combustion engine.

The FIGURE shows an internal combustion engine 1 that is provided with a combustion chamber containing a piston. In addition, an injection valve and a spark plug are assigned to the combustion chamber. If fuel is injected by the injection valve into the combustion chamber, and if this fuel is then ignited by the spark plug, the resulting combustion transmits a torque to a crankshaft via the piston. As a result, the crankshaft turns, causing internal combustion engine 1 to output power.

Internal combustion engine 1 is provided with a multiplicity of sensors, including an air-flow meter 2, an exhaust gas sensor 3, and a speed sensor 4.

To internal combustion engine 1 is assigned an electronic control unit that is used to control and/or regulate, in particular, the combustion of fuel in the combustion chamber of internal combustion engine 1. For this purpose, the control unit is provided with; a microprocessor that contains a stored program in a storage medium, in particular in a read-only memory, with this program being suitable to perform the entire control and/or regulation action.

Input signals that represent performance quantities of the internal combustion engine measured by sensors are applied to the control unit. Among other things, the control unit is connected to air-flow meter 2, exhaust gas sensor 3, and speed sensor 4. The control unit is also connected to a pedal sensor 5 that generates a signal indicating the position of an accelerator that can be operated by a driver.

The control unit generates output signals that can be used to influence the performance of the internal combustion engine via actuators, depending on the desired control and/or regulation action. For example, the control unit is connected to the injection valve and spark plug and generates the signals needed to activate them.

Based at least on the signals generated by pedal sensor 5 and speed sensor 4, the control unit calculates, in a block 6, a maximum permissible variation in the torque output by internal combustion engine 1 over a predetermined period of time. For example, the control unit calculates a maximum permissible torque variation of this type for a specific period of time lasting, for example, 1/10 second. The control unit thus determines the maximum amount by which the torque output by internal combustion engine 1 can vary, based on the accelerator position and speed of internal combustion engine 1 and possibly based on the variations of these quantities over this period of time.

Because the new torque should not begin, for example, until the accelerator position changes, the variation in torque also occurs later on and is thus delayed. This delay is dependent, for example, on the speed of internal combustion engine 1.

In a block 7, the control unit calculates an actual variation in the torque output by the internal combustion engine over a corresponding predetermined period of time, based on the signal generated by exhaust gas sensor 3 and/or air-flow meter 2. The control unit thus determines the maximum amount by which the output torque of internal combustion engine 1 has actually varied, based on the exhaust gas oxygen content and/or the intake air flow and possibly based on the variations of these quantities over the specified period of time.

The determination of the maximum permissible and actual torque variations, respectively, is always related to the predetermined period of time. The permissible and actual torque variations therefore do not represent absolute quantities, but rather relative quantities per time period.

The permissible and actual variations in the torque output by internal combustion engine 1 are compared to one another in a block 8. Therefore, the permissible and actual torque variations per time period are compared to one another. In doing this, the above-mentioned delay is taken into account. This means that a calculated maximum permissible torque variation is compared to a delayed actual torque variation, i.e., one that occurs at a later point in time.

If the actual variation in the torque output by internal combustion engine 1 is smaller than the maximum permissible variation in the output torque, this means that the sensors involved in controlling and/or regulating internal combustion engine 1 are essentially in proper working order. It also means that the control unit itself is in proper working order.

However, if the actual variation in the torque output by internal combustion engine 1 is greater than the maximum permissible variation in output torque, an error has occurred and an error signal F is generated.

This error may be due to the fact that the sensors involved in controlling and/or regulating internal combustion engine 1 are malfunctioning. In particular, it means that variations in the output signals have occurred in one or more of the sensors, for example, due to aging or other phenomena.

However, it is also possible that the control unit is no longer in proper working order in the above-mentioned error situation and has produced the error.

In each case, error signal F generates, for example, a corresponding indication for the driver in the above-mentioned error situation, or other actions can be taken to correct the error.

What is claimed is:

1. A method for detecting an error when operating an internal combustion engine, comprising the steps of:

at least one of controlling and regulating output power by an internal combustion engine as a function of performance qualities of the internal combustion engine and a driver request;

independently of the step of at least one of controlling and regulating, determining a permissible variation in the output power over a predetermined period of time and an actual variation, in the output power over a corresponding predetermined period of time, and comparing the permissible variation to the actual variation; and generating an error signal indicating a sensor error as a function of the comparison.

2. The method according to claim 1, wherein:

the internal combustion engine is for a motor vehicle.

3. The method according to claim 1, further comprising the step of:

determining the permissible variation in the output power as a function of the driver request.

4. The method according to claim 3, wherein:

the driver request includes a variation in position of an accelerator.

5. The method according to claim 1, further comprising the step of:

determining the permissible variation in the output power as a function of a speed of the internal combustion engine.

6. The method according to claim 1, further comprising the step of:

determining the actual variation of the output power as a function of at least one of an oxygen content of emitted exhaust gas and an intake air flow.

7. The method according to claim 1, further comprising the step of:

taking a delay into account, comparing the permissible variation in the output power to the actual variation in the output power.

8. The method according to claim 1, further comprising the step of:

generating the error signal if the actual variation in the output power over the predetermined period of time is greater than the permissible variation in the output power over the predetermined period of time.

9. The method according to claim 1, further comprising the step of:

converting the performance quantities of the internal combustion engine into torques.

10. The method according to claim 9, wherein:

the torques include a permissible variation in a torque output by the internal combustion engine and an actual variation in the torque output by the internal combustion engine.

11. An internal combustion engine having a control unit for detecting an error when operating the internal combustion engine, the control unit:

one of controlling and regulating output power of the internal combustion engine as a function of performance quantities of the internal combustion engine and a driver request;

determining, independently of at least one of the control and the regulation of the output power, a permissible variation in the output power over a predetermined period of time and an actual variation in the output power over a corresponding predetermined period of time;

comparing the permissible variation of the output power to the actual variation of the output power; and generating an error signal indicating a sensor error as a function of the comparison.

12. The internal combustion engine according to claim 11, wherein:

the internal combustion engine is for a motor vehicle.

13. A method for detecting an error when operating an internal combustion engine of a motor vehicle, comprising:

determining a permissible variation in output power of an internal combustion engine of a motor vehicle over a predetermined period of time and an actual variation in the output power over a corresponding predetermined period of time, and comparing the permissible variation to the actual variation; and providing an indication of a sensor error as a function of the comparison.

14. The method according to claim 13, further comprising:

independently of the indicating step, one of controlling and regulating output power of the internal combustion engine as a function of performance quantities of the internal combustion engine and a driver request.

* * * * *